US007004190B1

(12) United States Patent
Trangsrud

(10) Patent No.: US 7,004,190 B1
(45) Date of Patent: Feb. 28, 2006

(54) OUTSIDE DROP FOR MANHOLE

(76) Inventor: Julian P. Trangsrud, 300 Cherry St., Northfield, MN (US) 55057

( * ) Notice: Subject to any disclaimer, the term of this patent is extended or adjusted under 35 U.S.C. 154(b) by 0 days.

(21) Appl. No.: 11/106,408

(22) Filed: Apr. 14, 2005

(51) Int. Cl.
*E29D 29/12* (2006.01)

(52) U.S. Cl. ..... 137/375; 137/343; 137/363; 137/372; 248/74.4; 52/21

(58) Field of Classification Search ..... 137/362, 137/372, 343, 375; 248/65, 74.4; 52/21
See application file for complete search history.

(56) References Cited

U.S. PATENT DOCUMENTS 4,243,068 A * 1/1981 Sugda et al. ..... 137/363
4,566,483 A * 1/1986 Ditcher ..... 137/372
5,299,596 A * 4/1994 D'Alessandro ..... 137/363
6,695,002 B1 * 2/2004 Trangsrud ..... 137/372

* cited by examiner

*Primary Examiner*—A. Michael Chambers
(74) *Attorney, Agent, or Firm*—Nikolai & Mersereau, P.A.

(57) ABSTRACT

A protective collar for protecting the outside drop of a manhole having a U shaped housing extending from the outside wall of the manhole around the outside drop pipes and back to the outside wall. The protective collar having flanges at each end of the U shaped collar for attaching the collar to the outside wall of the manhole. The U shaped collar, having grooves on the inside for attaching rings, which surround the outside drop pipes. The rings having inside diameters, which vary to fit the size of pipe used by the outside drop such that are size collar works with any size outside drop pipe. An elbow attached to the outside of the manhole wall and to the protective collar such that the outside drop pipe connects to the elbow. Thus the outside drop is totally protected from being moved relative to the manhole which may cause leaks.

4 Claims, 14 Drawing Sheets

OUTSIDE DROP FOR MANHOLE

BACKGROUND OF THE INVENTION

1. Field of the Invention

This invention relates to a collar attached to the side of a manhole to protect an outside drop adjacent the manhole.

2. Description of the Related Art

When an outside drop is used adjacent a manhole the outside drop is subject to damage and subsequent leaks by rocks and other fill material and due to shifting of the ground, the weight of the pipes and other factors. It is desired to have a protective collar around the drop pipe that will hold the pipes in place.

Currently protective collars are very heavy which makes them difficult and expensive to transport and install. The protective collars in use need to be set on a solid base as part of the base of the manhole, which makes the manhole itself heavier, more expensive, labor intensive and more difficult to install in the ground. The collars surrounding a drop pipe must be made the correct size to support the drop pipe, collars and connections, particularly at the top of the outside drop where there is a T connection and at the bottom of the outside drop where there is an elbow pipe connection. Since riser collars are made of concrete they are very heavy and require tools to lift the collar parts into place and in some cases cement mortared together. Since the riser collars are not fastened to the manhole they may have gaps between the manhole and the collar or may shift way from the manhole.

Outside drop pipes are generally made from ductile iron, which is heavy, expensive and hard to work with and are protected by a concrete collar. Plastic pipe is lighter, costs less, is easier to connect and easier to work with. However plastic pipe is more subject to damage and needs protection.

Prior plastic collars for outside drops on manholes, such as applicant's prior patent U.S. Pat. No. 6,695,002, required assembly of two halves of the collar at the job site and several collar sections for the height of the drop. The outside drop pipes can be of several different diameters, which require different sized collars. It is desired to have a one-piece collar of one diameter for any size outside drop pipe.

SUMMARY OF THE INVENTION

A one-piece collar attached to the outside of a manhole extends the length of the outside drop to surround the outside drop and protect it from damage. The collar connects to a combination elbow joint and protective collar at the base of the outside drop.

The protective collar attaches to the manhole and had rings supported in ring holders in the protective collar. The rings have different size inside diameters for engaging different diameter outside drop pipes. In this manner only one size protective collar is required for any size outside drop pipes.

The protective collar is a one-piece unit, which surrounds the outside drop pipe and is attached to the manhole. The one piece protective collar does not have to be assembled around the outside drop pipes as in prior designs which saves labor, is quicker and easier to install and cuts down on the number of pipes required.

The one-piece protective collar can be made in one length and cut to the desired length for short outside drop lengths or stacked for long outside drop lengths. Therefore only one size mold needs to be made for the protective collar further reducing production and inventory costs.

OBJECTS OF THE INVENTION

It is an object of the invention to provide a lightweight outside drop protector for a manhole.

It is an object of the invention to provide an easy to install outside drop protector for a manhole at the work site, which requires less labor to assemble.

It is an object of the invention to provide a low cost outside drop protector for a manhole.

It is an object of the invention to provide a one size outside drop protector for a manhole for use with any size outside drop pipes by use of rings between the outside drop protector and the outside drop pipe.

It is an object of the invention to provide a stackable outside drop protector for adjusting the height of the outside drop protector.

It is an object of the invention to provide an outside drop protector, which can be cut to the size of the outside drop pipe length.

It is an object of the invention to provide an elbow for the outside drop protector, which connects to both the outside drop pipes and to the manhole.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
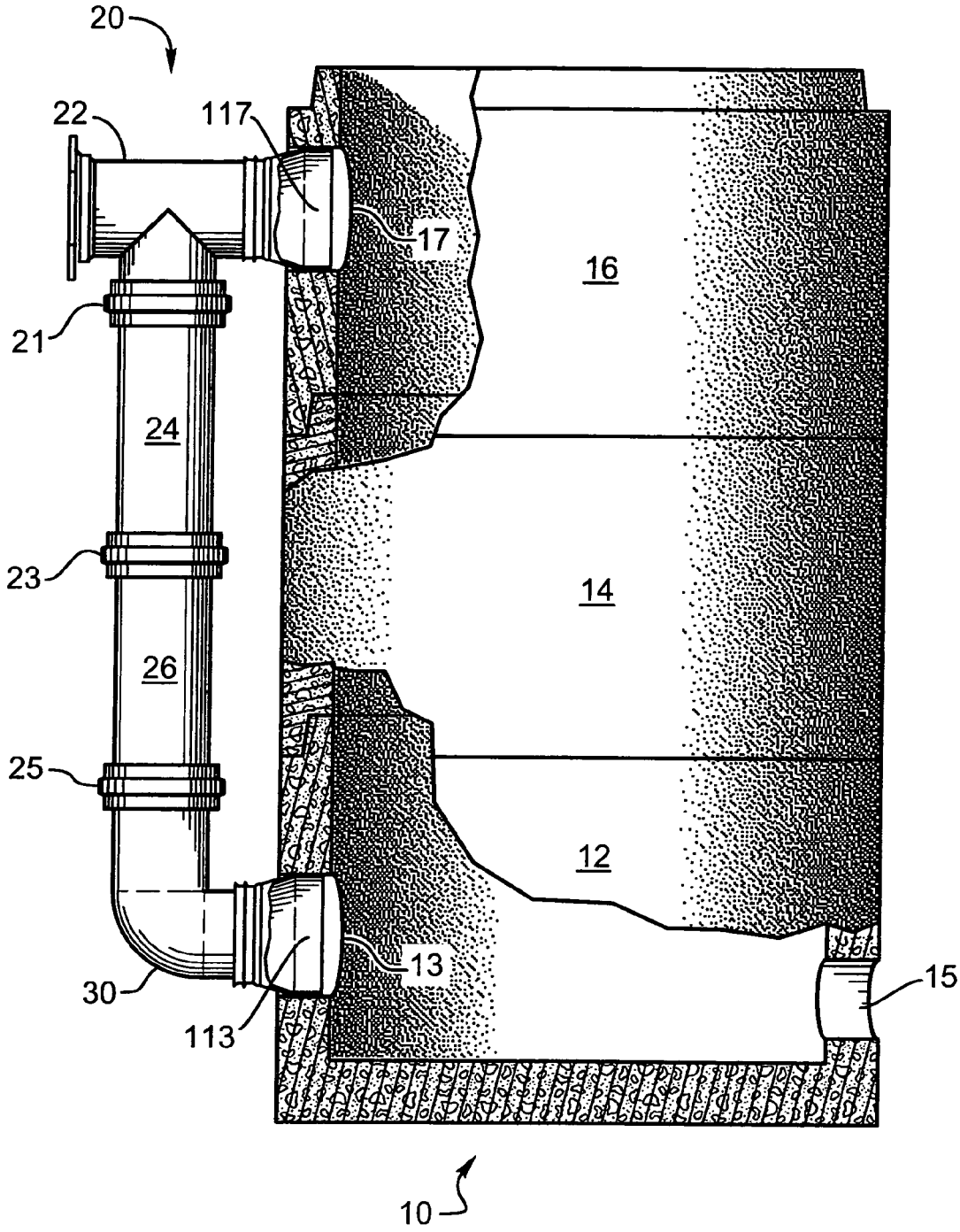
FIG. 1 is a side cross sectional view of an outside drop pipe adjacent a manhole.
Figure 2:
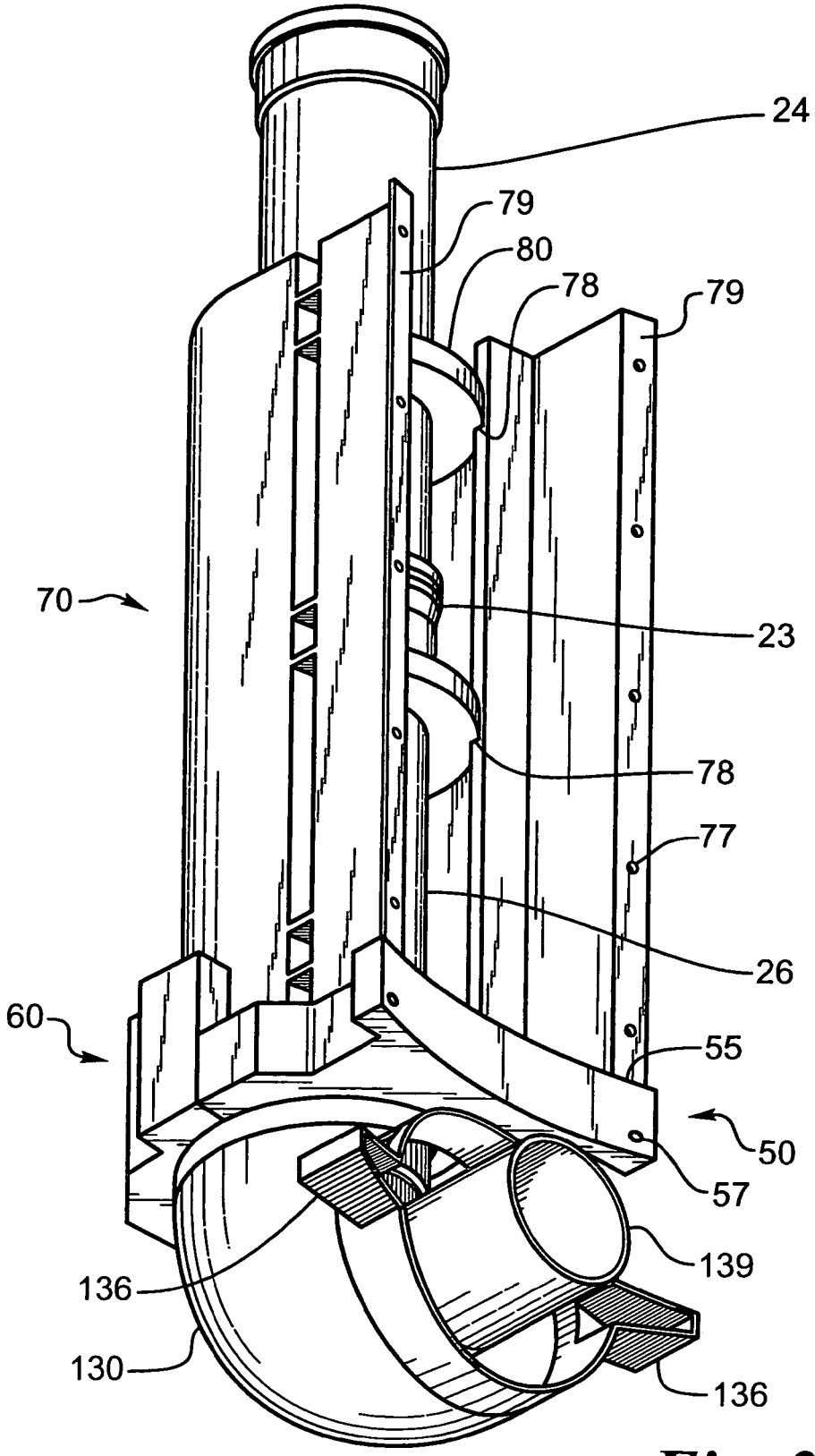
FIG. 2 is a side cross sectional view of an outside drop pipe having a protective collar.

A manhole 10 with an outside drop 20 is shown in FIG. 1. The manhole in the embodiment shown is assembled on site out of three sections. The bottom section 12 has an inlet aperture 13 with a bottom inlet pipe 113 connected to elbow 30 on the outside drop 20. The middle section 14 is set on top of bottom section 12 and the top section 16 is set on top of middle section 14. The top section 14 has inlet aperture 17 with a top inlet aperture pipe 117 attached to T connection 22.

The outside drop 20 has T connection 22, which is connected to first outside drop pipe 24 at flange connection 21. The base of the first outside drop pipe 24 is connected at flange connection 23 with the top of second outside drop pipe 26. The base of second outside drop pipe 26 is connected at flange 25 with the elbow 30. Elbow 30 connects to the manhole at base pipe 13.

Typically the pipes 24, 26 and the elbow 30 would be made out of ductile iron however the trend is now to use plastic pipes which are easier to install, easier to work with and cost less than ductile iron pipes. The draw back is that plastic pipes need more protection such as by a protective collar 70.

Figure 3:
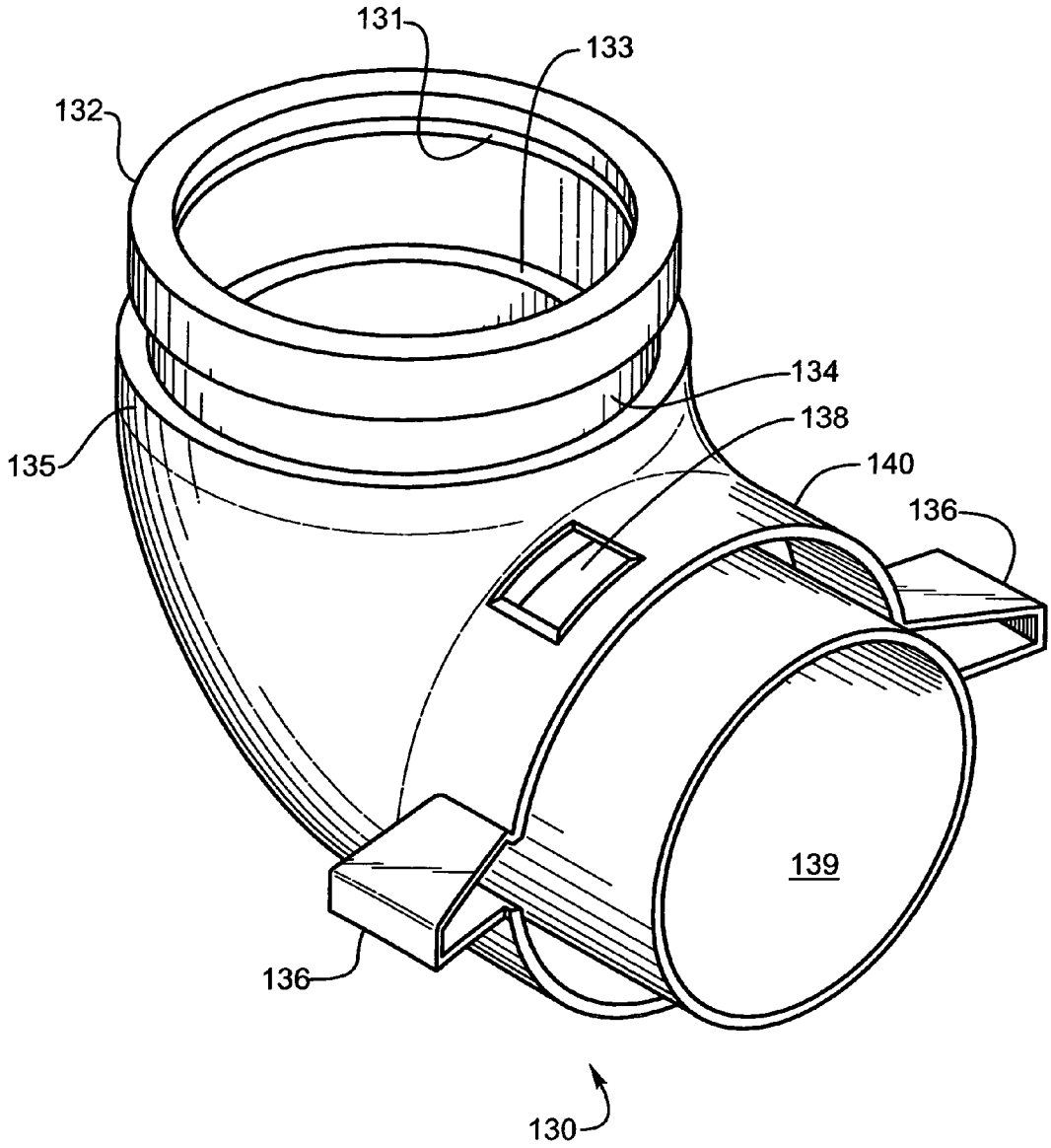
FIG. 3 is a front perspective view of the elbow.
Figure 4:
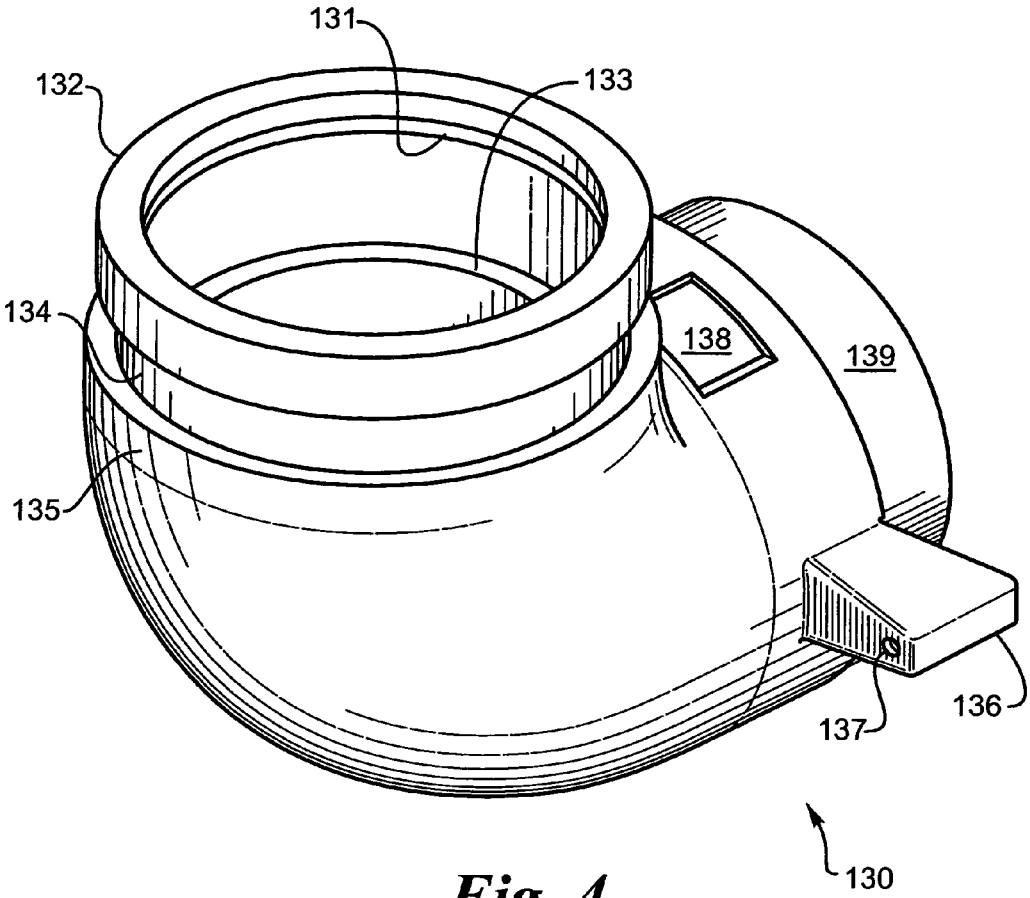
FIG. 4 is a rear perspective view of the elbow.
Figure 5:
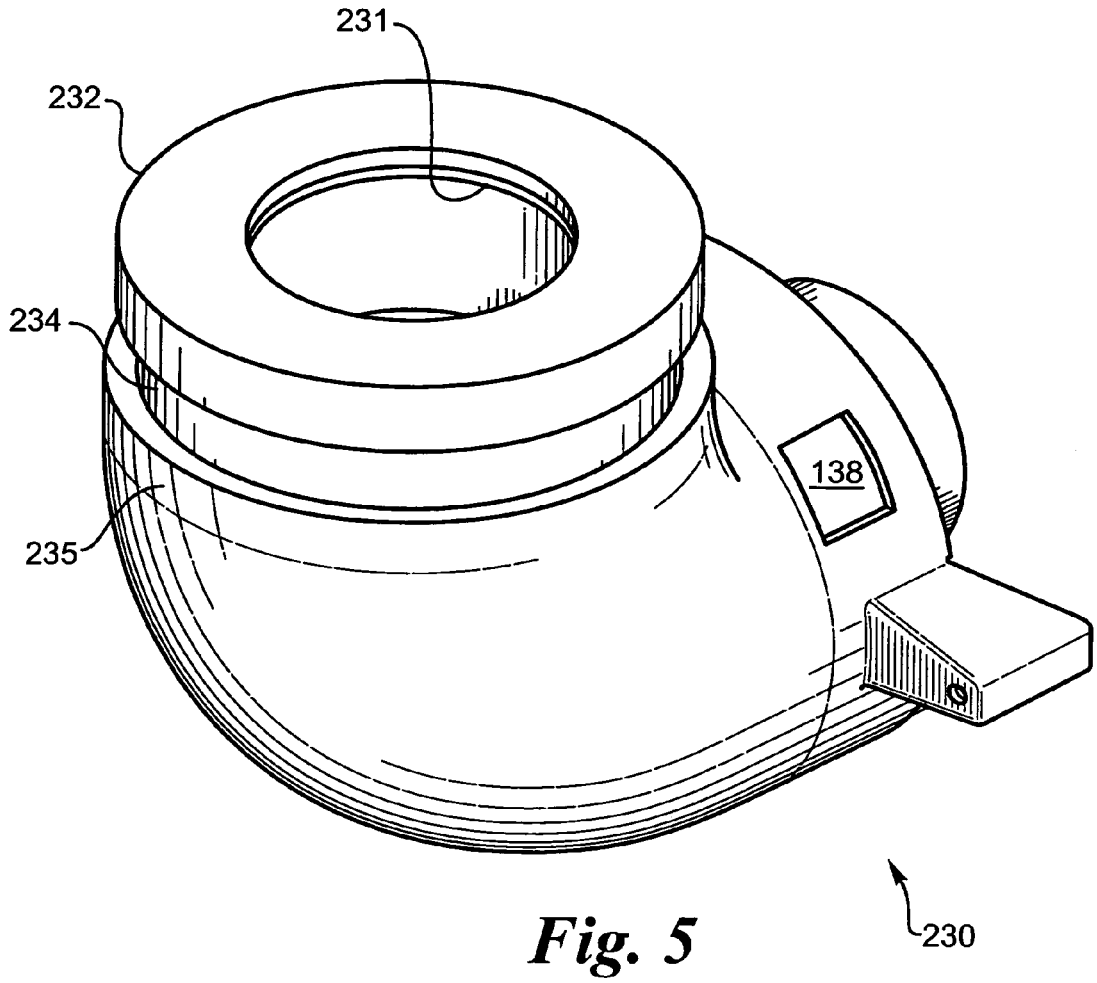
FIG. 5 is a rear perspective view of the elbow on a second embodiment.

When installing an outside drop 20 on a manhole 10 with the protective collar 70, first an elbow 130 such as shown in FIGS. 3 and 4 or elbow 230 such as shown in FIG. 5 is attached to the bottom inlet aperture pipe 113 at the bottom of the manhole 10.

Elbow 130 differs from elbow 230 in the top flange 232 on elbow 230 having a restricted opening, which is used for a smaller diameter pipe 26. Typically elbow 130 would be for a 10 inch (25.4 centimeter) pipe 26 whereas elbow 230 would be used for an 8 inch (20.32 centimeter) pipe 26. Alternatively an elbow and collars can be used on 12 inch (30.48 centimeter) pipes or for any other size pipes.

Elbow 130 has a pipe engaging portion 139 for attachment to the bottom aperture pipe 113. Elbow 130 also has tabs 136 with apertures 137 for attaching elbow 130 to the manhole 10 with bolts. Aperture 138 in elbow connector flange 140 is for tightening a seal around the bottom aperture pipe 113. Flanges 132 and 135 define an attachment groove portion 134 for securing the elbow 130 to the manhole 10 by engagement with flange 54 on front support collar 50 and flange 64 on rear support collar 60. The front support collar 50 and rear support collar 60 are attached by bolts passing through apertures 58 and 59 in front support collar 50 and entering apertures 68 and 69 in rear support collar 60 to lock the front and rear support collars 50 and 60 around elbow 130. Then the elbow 130 is secured to the manhole 10 by bolts passing thought apertures 57 in tabs 56 on front support collar 50.

Figure 6:
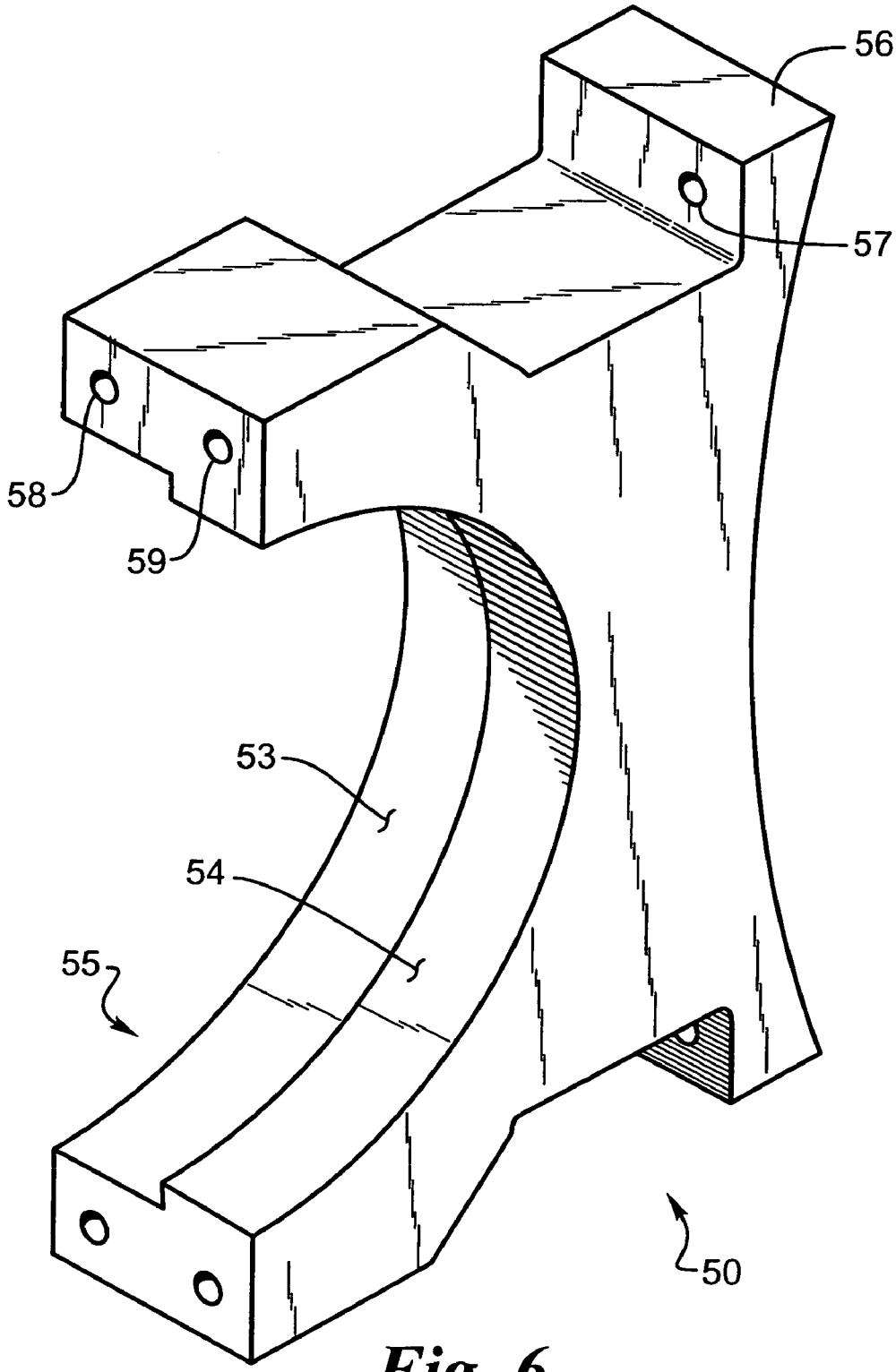
FIG. 6 is a bottom front perspective view of the front support.
Figure 7:
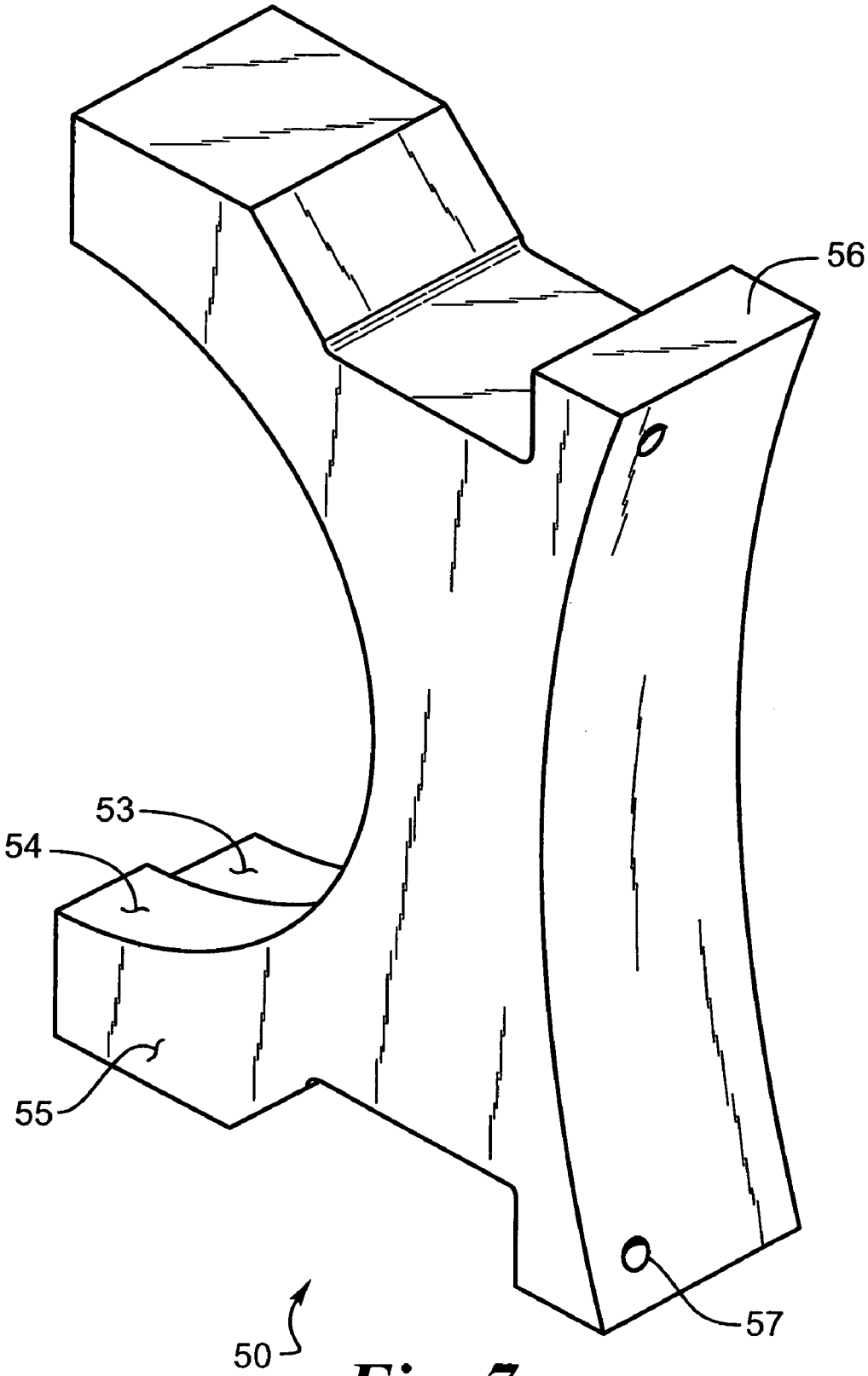
FIG. 7 is a top rear perspective view of the front support.
Figure 8:
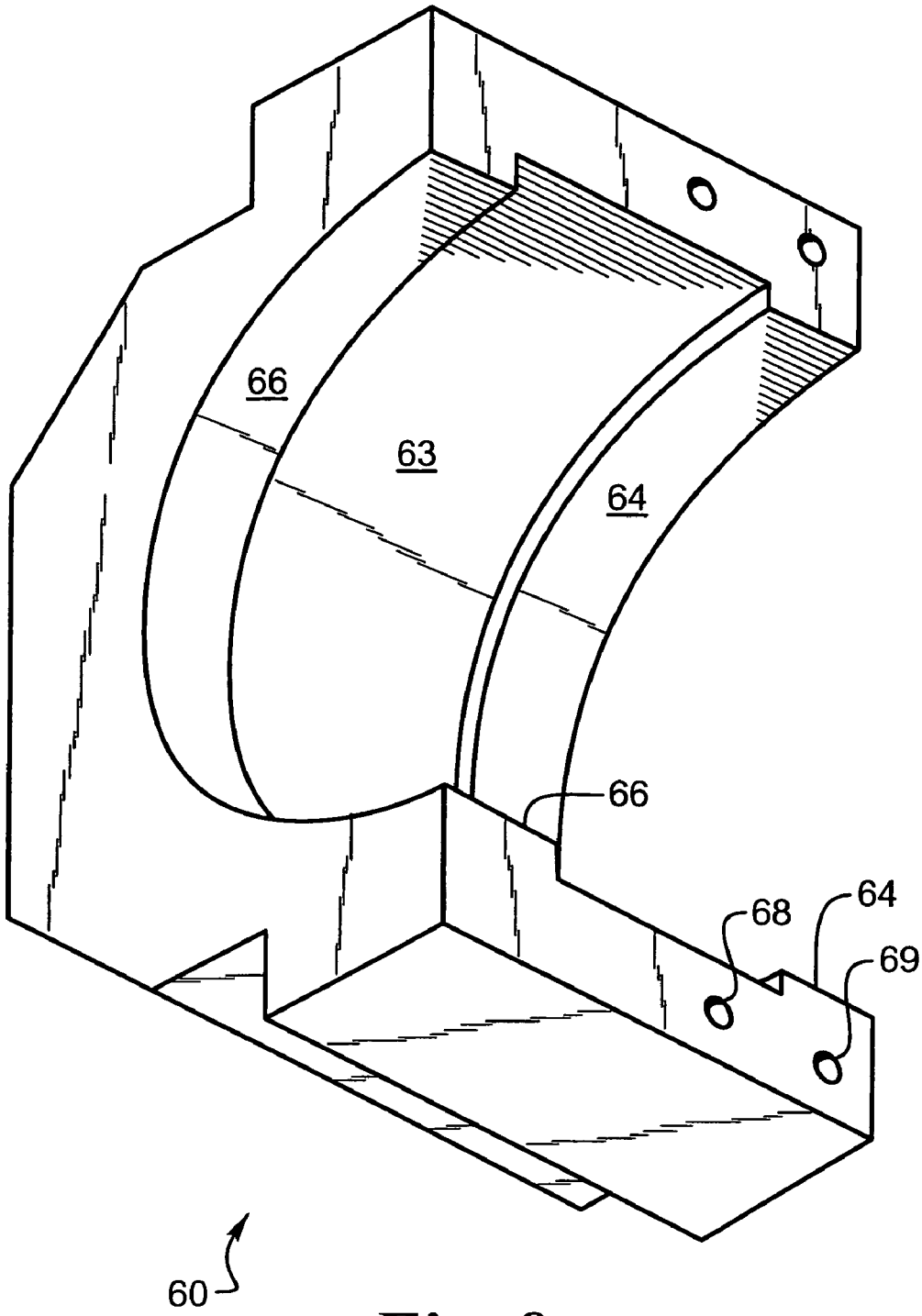
FIG. 8 is a top front perspective view of the rear support.
Figure 9:
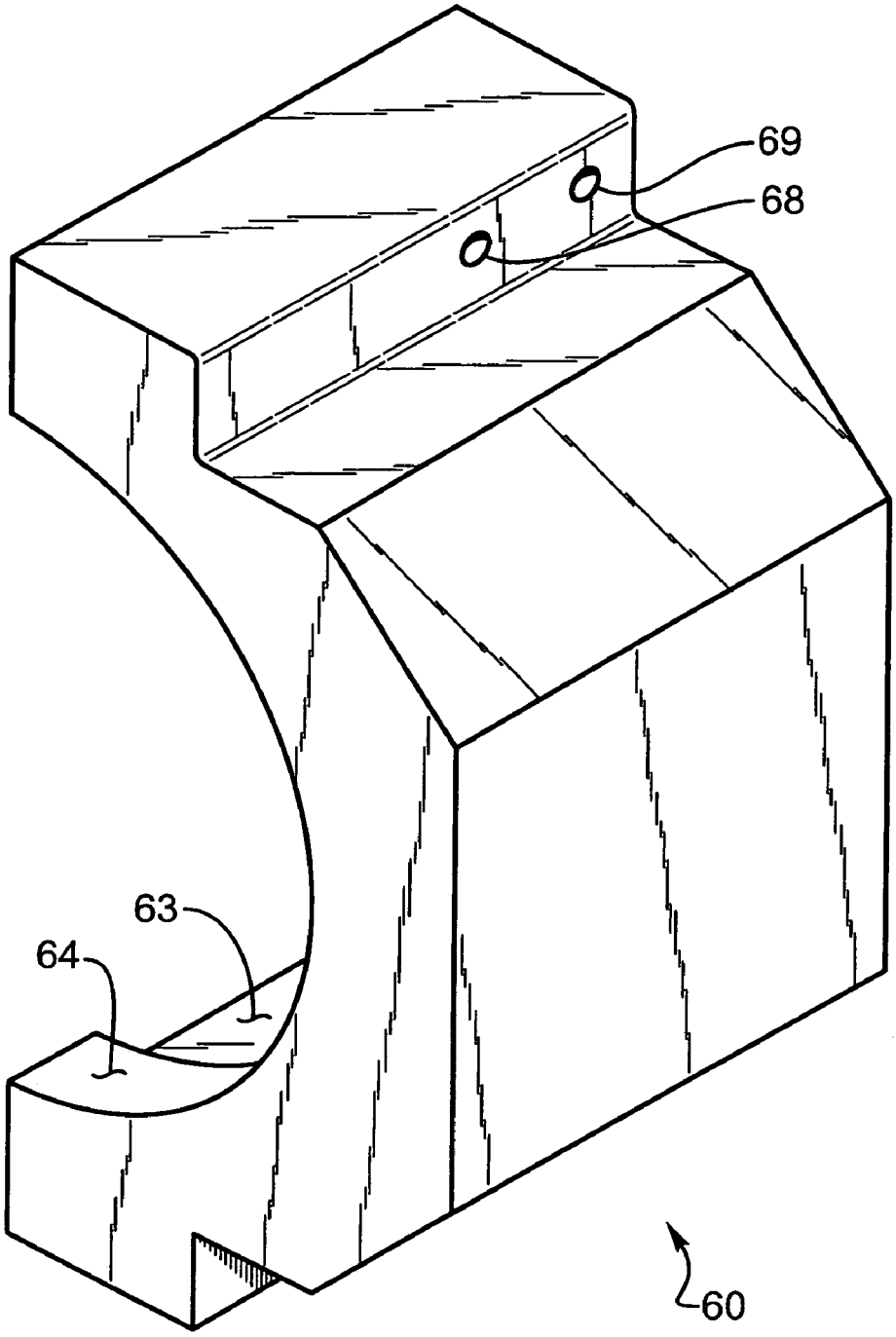
FIG. 9 is a top rear perspective view of the rear support.
Figure 10:
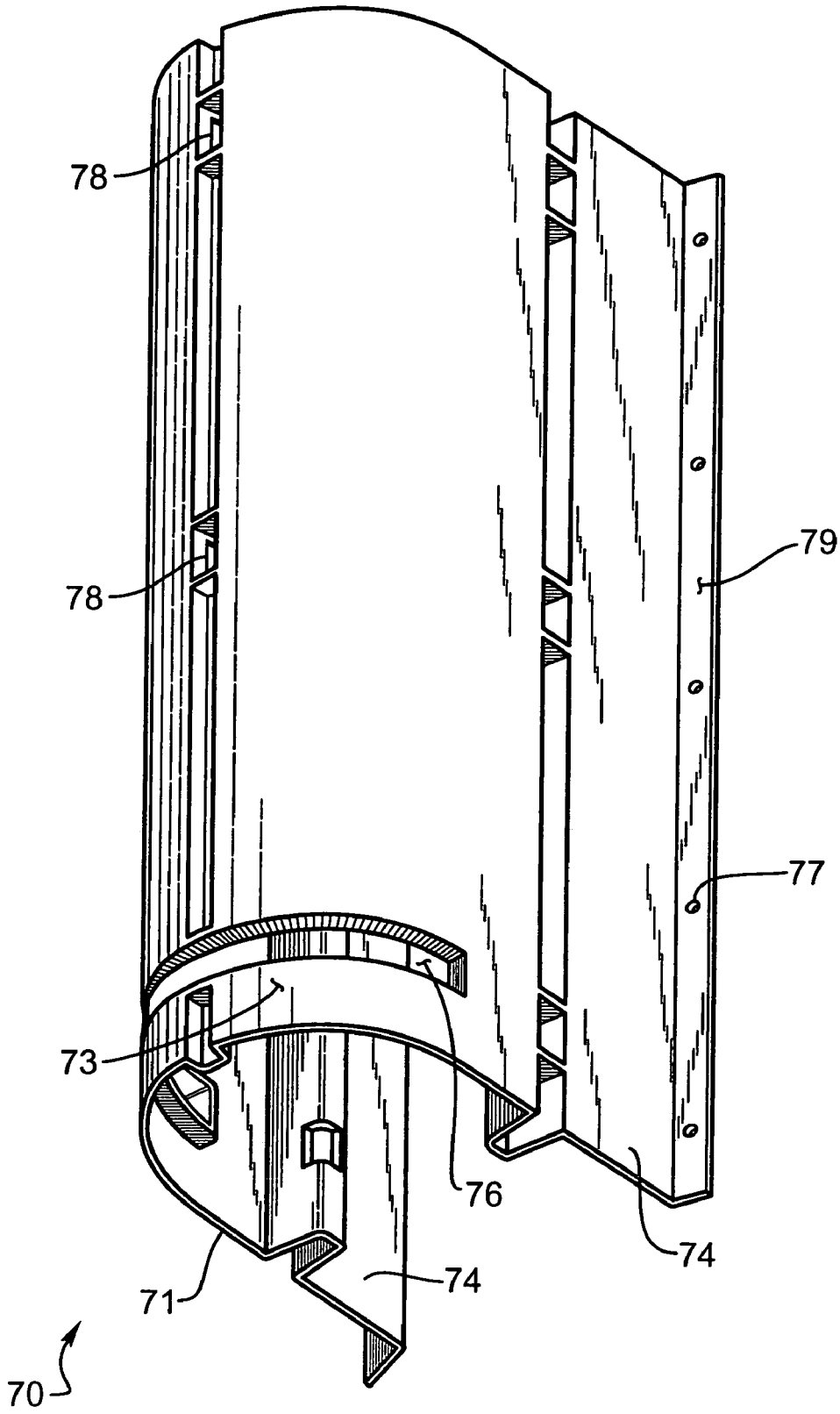
FIG. 10 is a front perspective view of the protective collar.
Figure 11:
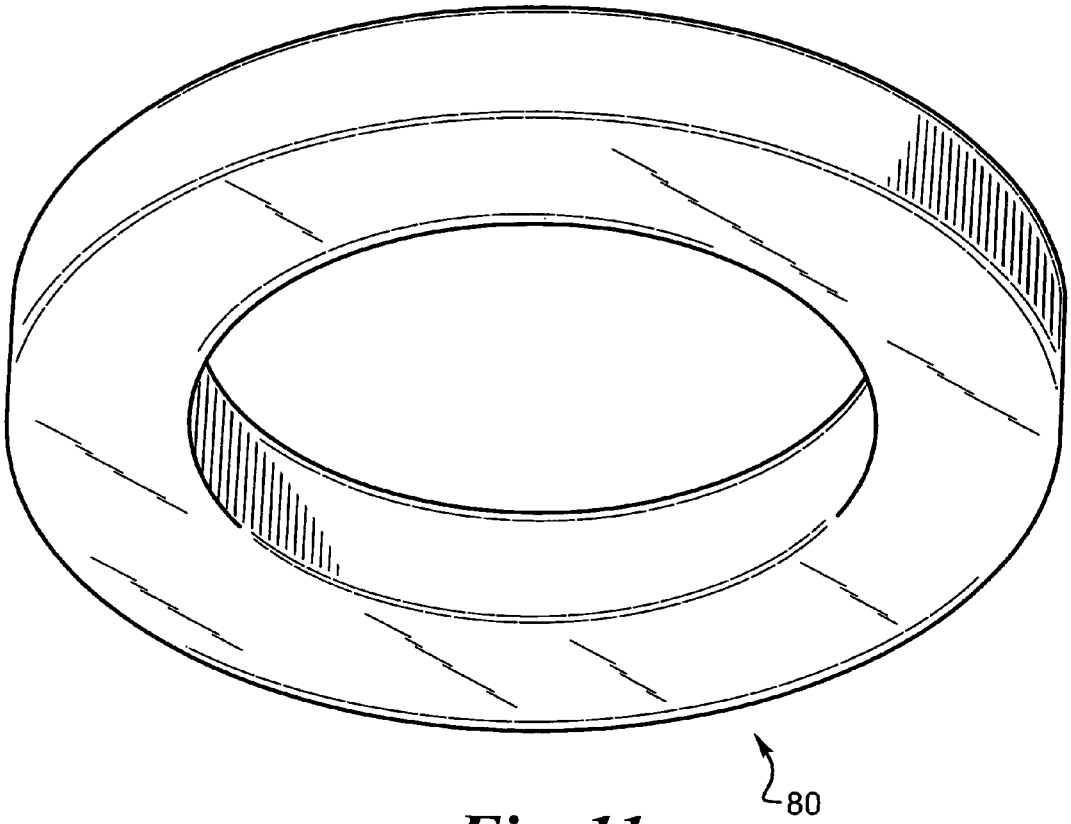
FIG. 11 is a perspective view of a pipe ring.
Figure 12:
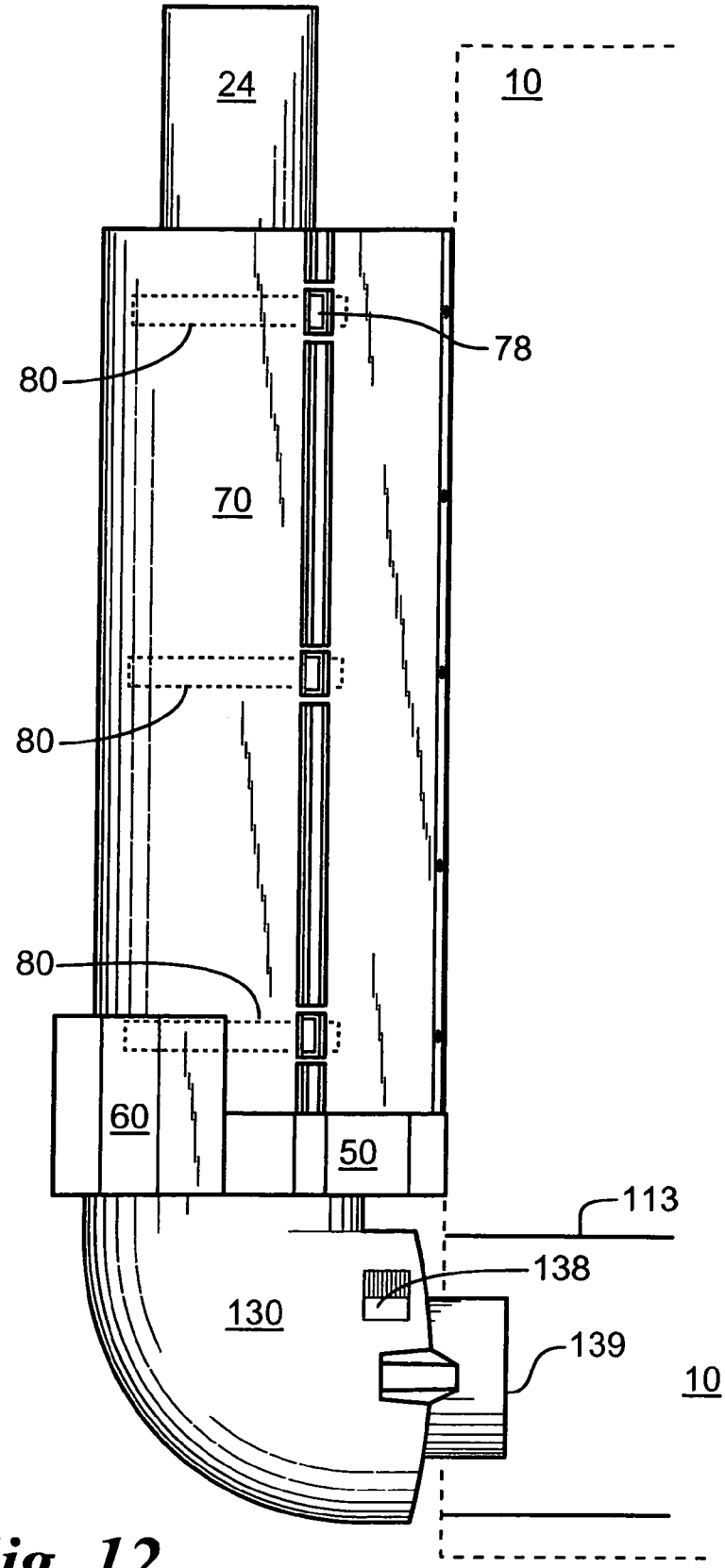
FIG. 12 is a side view of a the protective collar installed on an outside drop manhole.
Figure 13:
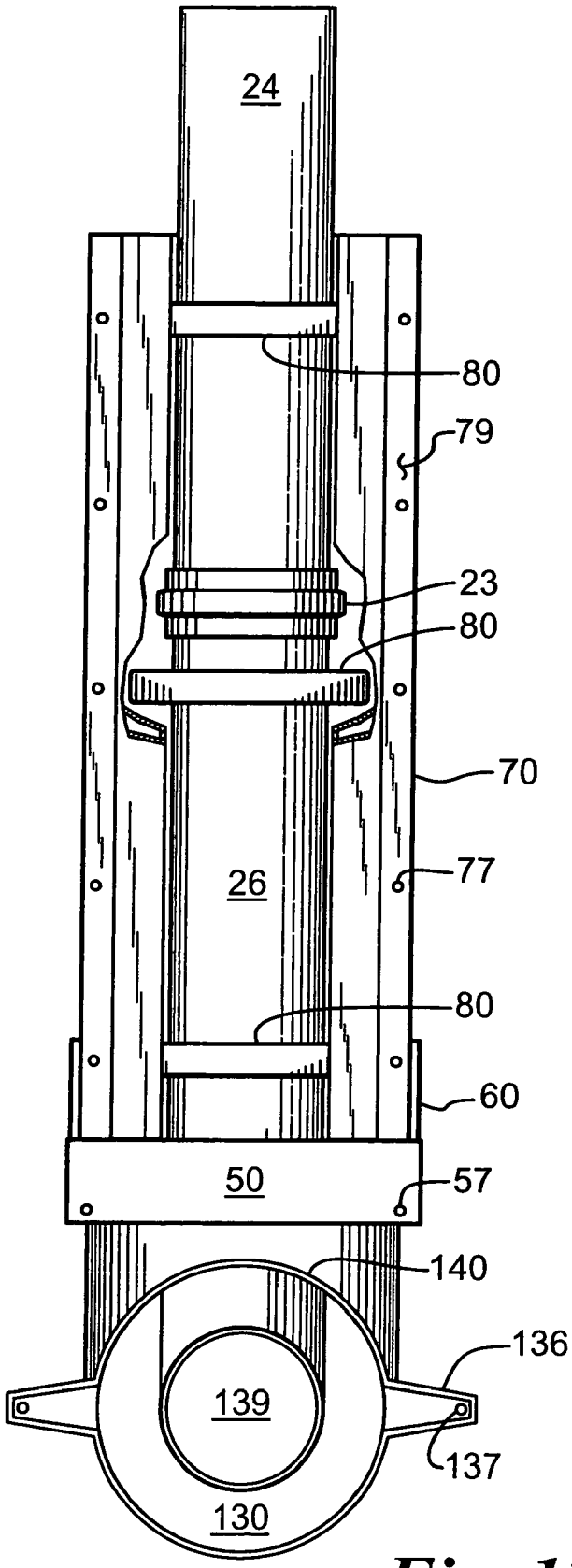
FIG. 13 in a rear view of the protective collar around the outside drop pipes.

As shown in FIGS. 6 and 7 the front support collar 50 has flange 54, which engages groove 134 in elbow 130 while wall 53 on front support collar 50 engages flange 132 on elbow 130. As shown in FIGS. 8 and 9 the rear support collar 60 has flange 64, which engages groove 134 in elbow 130 while a portion of wall 63 on rear support collar 60 engages flange 132 on elbow 130.

Once the elbow 130 is installed the outside drop protective collar 70 containing pipes 24 and 26 held in place by rings 80 may be attached to the manhole 10 with pipe 26 connected to the elbow 130 and the outside drop protective collar 70 connected to the rear support collar 60 while resting on front support collar 50.

As seen in FIG. 4, flange 133, in elbow 130 stops further progress of pipe 26 in the elbow. A gasket ring 131 supports a gasket or o-ring, which engages the side of pipe 26 to form a leak proof connection. Pipe 26 is held in place within outside drop protective collar 70 by ring 80, which secures it from lateral movement within the outside drop protective collar 70. The rings 80 fit into slots 78 in the outside drop protective collar 70 to hold the rings in place. The rings 80 have different inside diameters depending on the outside diameters of the pipes 24, 26. Thus one size outside drop protective collar 70 can hold many different size pipes 24, 26 with the aid of different size rings 80. One size outside drop protective collar 70 allows for ease of installation as only one size outside drop protective collar 70 need be made and inventoried on the job site thereby cutting costs. To assemble the outside drop protective collar 70 the rings for pipe 26 are installed on the pipes 24, 26 and the pipes 24 and 26 are connected at flanges 23. Then the rings are pushed into the ring slots 78 in the outside drop protective collar 70 by spreading the arms 72, 74 of the U shaped outside drop protective collar 70.

The base 71 of the outside drop protective collar 70 engages the top 55 of front support 50. The rear support 60 has flange 66 for engaging groove 76 in the back of the outside drop protective collar 70 for securing the outside drop protective collar 70 to the assembly and flange 73 on the outside drop protective collar 70 is secured in groove 63 in the rear support collar 60. With the outside drop protective collar 70 in place the bolts in apertures 68, 69 on rear support collar 60 can be tightened into the apertures 58, 59 on front support collar 50. Bolts may now be placed through apertures 77 on flanges 79 to secure the outside drop protective collar 70 to the manhole 10. The outside drop pipes 24 and 26 are now secured in place and protected against movement relative to the manhole caused by fill placed around the manhole.

Figure 14:
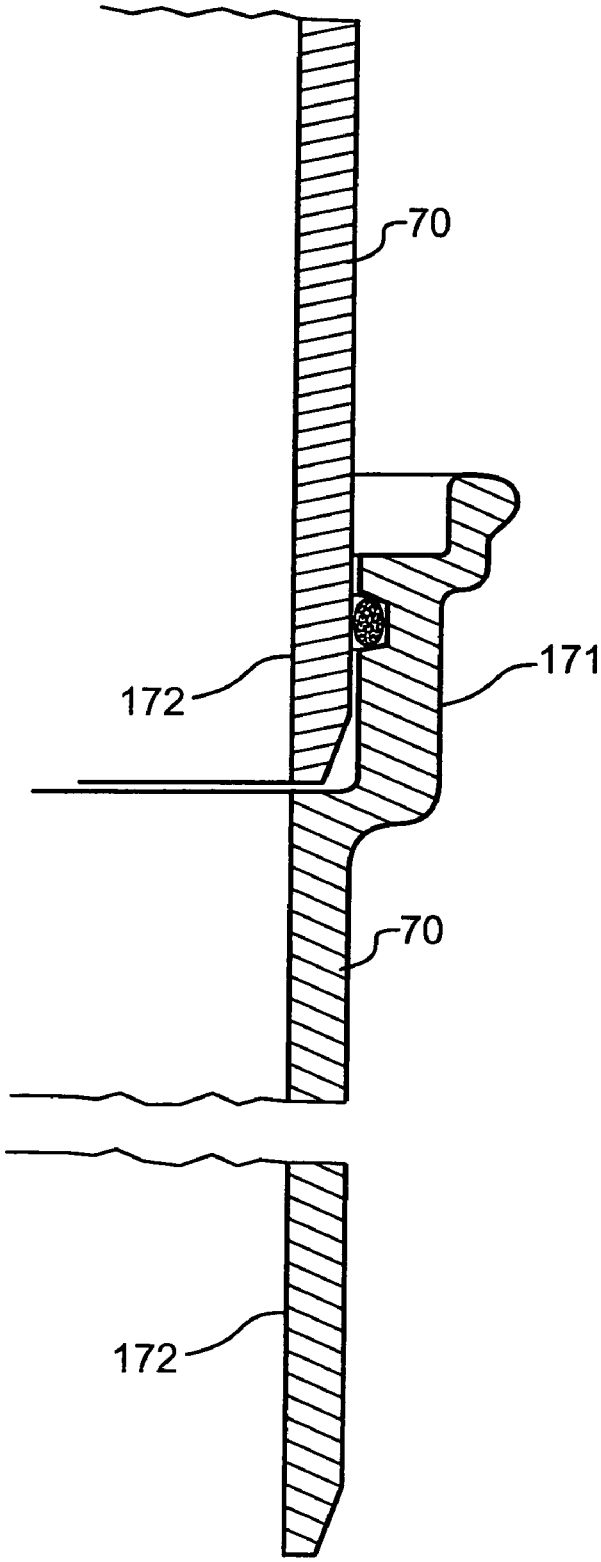
FIG. 14 is a side cross section of the overlapping connection of two outside drop sections.

Stacking of the outside drop protective collar 70 sections can used to extend the height of the protected area of the outside drop 20 is one section of the outside drop protective collar 70 is not enough. In order to stack the outside drop protective collar sections 70 overlapping portions 171 at the top of one outside drop protective collar 70 and 172 at the bottom of another outside drop protective collar 70 help align the stack. As shown in FIG. 14 the top 171 has a smaller diameter that the bottom 171 of outside drop 70 permitting the overlapping stacked connection. The top portion of an outside drop protective collar 70 may be cut off to match the length of the pipe 24 being protected.

In an alternative embodiment the protective collar 70 can be attached to the outside of the manhole from just below the T connection 22 to just below the base of the elbow 130 thus protecting the entire outside drop 20.

Obviously, many modifications and variations of the present invention are possible in light of the above teachings. It is therefore to be understood that, within the scope of the appended claims, the invention may be practiced otherwise than as specifically described.

What is claimed is:

1. An outside drop protective collar for a manhole comprising, a U shaped protective collar having two arms each with a flange having apertures for bolts to secure the collar to a manhole, at least one ring engaging groove in the U shaped collar, a ring fitting into the at least one ring engaging groove to secure a ring in place, wherein the ring surrounds a pipe to be held in place.

2. An outside drop protective collar for a manhole as in claim 1 wherein, an elbow having a pair of tabs with apertures for bolts to secure the elbow to the manhole, the elbow having a pipe engaging portion for engaging a pipe at the base of the manhole, the elbow having a top flange and a bottom flange at the top of the elbow with a groove defined by the top flange and the bottom flange, a U shaped front collar having a flange for engaging a portion of the groove in the elbow, a tab on the U shaped front collar having an aperture for bolts to secure the tabs to a manhole, a U shaped rear collar having a flange for engaging a portion of the groove in the elbow, and having a means to secure the front collar to the rear collar to surround the groove in the elbow.

3. An outside drop protective collar for a manhole as in claim 2 wherein, the U shaped protective collar having a groove on the outside diameter, the U shaped rear collar having a flange for engaging a portion of the groove in the outside diameter of the U shaped protective collar to connect the U shaped protective collar to the U shaped rear collar, thus securing the U shaped protective collar in position relative the elbow and holding a pipe inside the rings of the U shaped protective collar such that the pipe connects to the elbow.

4. An outside drop protective collar for a manhole as in claim 2 wherein, an aperture inside the elbow connector flange allows a seal to be tightened such that the elbow is connected to a bottom connector pipe in the base of the manhole.

* * * * *